US005272385A

United States Patent [19]

Cravero

[11] Patent Number: 5,272,385

[45] Date of Patent: Dec. 21, 1993

[54] PHOTOGRAPHIC AND X-RAY FILM PROTECTION SYSTEM

[76] Inventor: Humberto A. Cravero, 12 Kay St., Carlingford, Australia, NSW 2118

[21] Appl. No.: 506,094

[22] Filed: Apr. 9, 1990

Related U.S. Application Data

[63] Continuation of Ser. No. 162,911, Mar. 3, 1988, abandoned.

[51] Int. Cl.[5] ..... H01H 35/00

[52] U.S. Cl. ..... 307/116; 307/117; 307/113; 307/142

[58] Field of Search ..... 361/173, 174, 175, 144; 307/116, 117, 142, 113

[56] References Cited

U.S. PATENT DOCUMENTS

| | | | |
|---|---|---|---|
| 4,833,461 | 5/1989 | Yeager | 340/690 |
| 4,841,164 | 6/1989 | Basso | 307/117 |
| 4,902,906 | 2/1990 | Murphy | 307/117 |

*Primary Examiner*—Jeffrey A. Gaffin

[57] ABSTRACT

An electronic device comprising a light sensor, a plurality of inputs and outputs, and an integrated circuit provides discrimination from logic input detection signals to generate output signals. The input detection signals are received from slotted opto-interrupter devices installed at a door and a lid of a hopper and also from a light sensor. Electric locks responsive to the output signals are installed at the door and the lid while an electronic relay is installed at a light switch and power socket. The device will not allow the hopper's lid to be opened if the room's door is open and/or the room's light is turned on. When the hopper's lid is opened the door automatically locks and electric power to the light switch and power socket is interrupted. When the hopper's lid is open and the light switch is turned to the ON position, the light will not turn ON until the hopper's lid is closed. Once the hopper's lid is closed, the presence of light will cause the device to instantly and automatically lock the hopper's lid and unlock the door.

6 Claims, 1 Drawing Sheet

PHOTOGRAPHIC AND X-RAY FILM PROTECTION SYSTEM

This is a continuation of application Ser. No. 162,911 filed on Mar. 3, 1988 now abandoned.

BACKGROUND OF THE INVENTION

The following invention relates to a photographic and X-Ray film protection system. X-Ray film used in hospitals and by medical practitioners is often stored in a "hopper" or other special cabinet. Such hopper or cabinet is normally situated within a dark room and contains large quantities of expensive X-Ray film. Often such film is damaged by inadvertent opening of a lid provided on the hopper resulting in light entering the hopper. Typically, light may enter the hopper when one enters the dark room while the hopper is open allowing light to enter through the dark room door to the hopper. Damage can also occur to the film where a light in the dark room is switched on when the hopper lid is opened.

It is the object of the present invention to provide a means by which inadvertent damage to the expensive X-Ray film stored in a hopper in a dark room is prevented or at least minimized.

SUMMARY OF THE INVENTION

There is disclosed herein an apparatus to prevent inadvertent opening of a lid to a hopper or cabinet in which light sensitive material may be stored, the hopper or cabinet in use being located in a dark room having an entry door, the apparatus comprising;

- photosensitive means to detect a change of light in the dark room and to produce a first signal indicative of said change of light,
- door open/closed detection means to detect an open/closed state of the door and to produce a second signal indicative of said open/closed state of the door,
- lid open/closed detection means to detect an open/closed state of the lid and to produce a third signal indicative of said open/closed state of the lid,
- electrically controlled door lock means to lock/unlock the door,
- electrically controlled lid lock means to lock/unlock the lid, and
- logic circuit means responsive to said first, second and third signals to produce control signals for controlling the door lock means and the lid lock means.

Typically, input detection signals are received from slotted opto/interrupter devices installed at the door and the lid of the hopper.

Preferably, the logic circuit means produce further control signals to control a light in the dark room and/or a power socket provided in the dark room.

Advantageously, the photosensitive means comprises an adjustable sensitivity control so as to allow non-detection of a change of a non-damaging light in the dark room such as red light.

The apparatus disclosed herein will typically prevent the hopper's lid from being opened if the room's door is open and/or the room's light is on.

Advantageously, when the hopper's lid is opened the door automatically lock and electrical power to the light switch and/or to a power socket is interrupted. When the hopper's lid is open, should the light switch be turned ON and left in the ON position, the light will not turn on until the hopper's lid is closed. Typically, the presence of light causes the system to instantly and automatically lock the hopper's lid and unlock the door to the dark room.

There is further disclosed herein a method of preventing inadvertent opening of a lid to a hopper or cabinet in which light sensitive material may be stored, the hopper or cabinet, in use, being located in a dark room having an entry door, the method comprising;

- detecting by photosensitive means a change of light in the dark room as to produce a first signal indicative of said change of light,
- detecting by way of open/closed detection means an open/closed state of the door so as to produce a second signal indicative of said open/closed state of the door,
- detecting by way of lid open/closed detection means an open/closed state of the lid so as to produce a third signal indicative of said open/closed state of the lid,
- providing electrically controlled door lock means to lock/unlock the door,
- providing electrically controlled lid lock means to lock/unlock the lid, and
- providing logic circuit means which respond to said first, second and third signals so as to produce control signals for controlling the door lock means and the lid lock means.

BRIEF DESCRIPTION OF THE DRAWING

A preferred form of the present invention will now be describe by way of example with reference to FIG. 1 which illustrates a square rectification chart comprising an electronic unit depicted within a border line and remote devices outside of the border line.

DETAILED DESCRIPTION OF THE INVENTION

Figure 1:
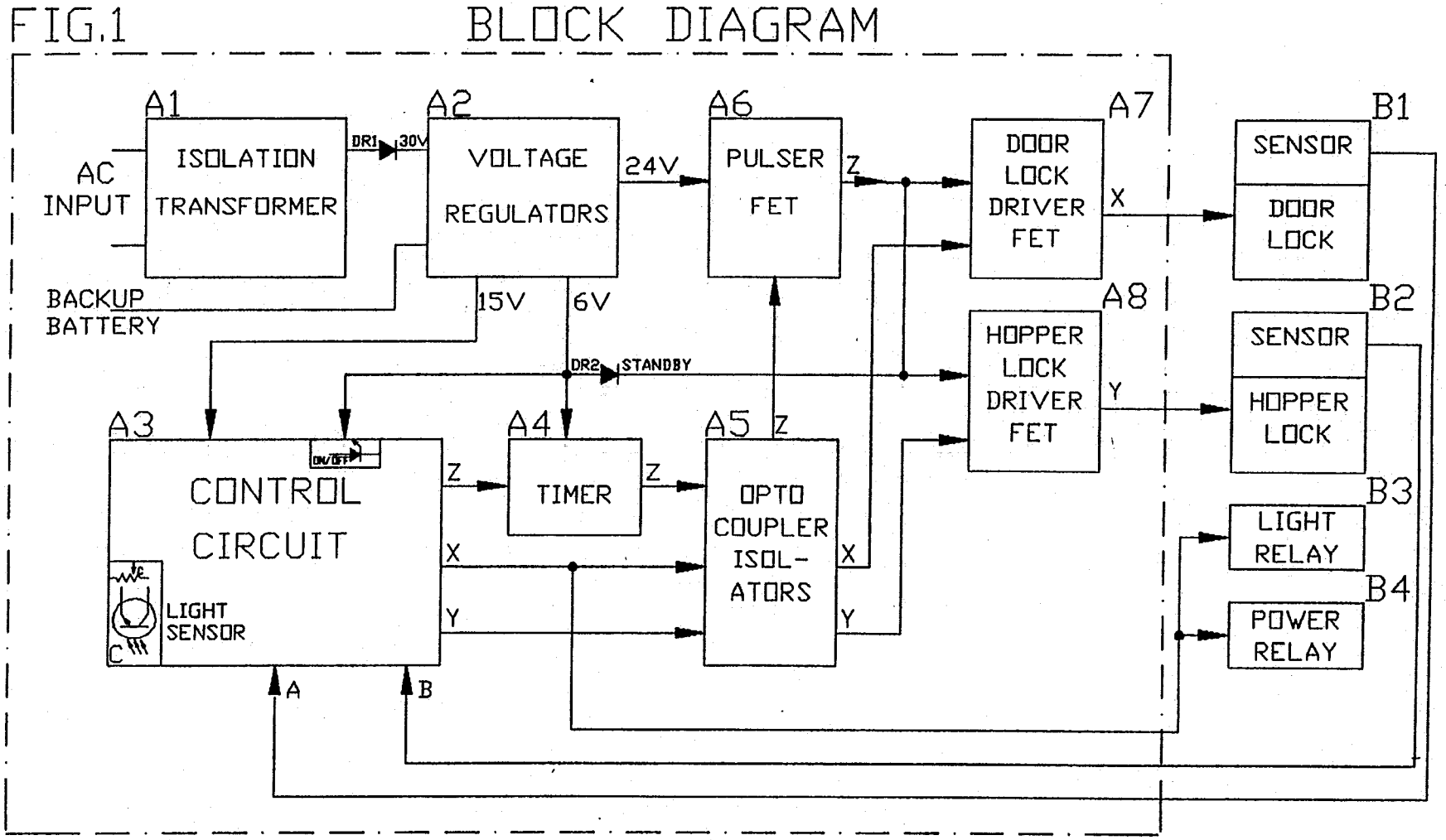

The preferred embodiment of the invention comprises an AC isolation transformer A1, rectifier network DR1, three voltage regulators A2, control circuits comprising an adjustable sensitivity light sensor, a discriminator circuit with inputs to receive Hi and Lo information and outputs to deliver Hi and Lo control signals A3, a 500 m/s timer A4, a set of three opto coupler/isolators A5, a power FET pulser driver A6, a power FET X output A7, a power FET Y output A8, a door open/close detector comprising a slotted opto/interrupter and electric lock B1, a lid open/close detector comprising a slotted opto/interrupter and electric lock B2, two opto coupler/isolator driven electronic relays B3 and B4; in which AC isolation transformer A1 delivers a voltage which is rectified though DR1 to obtain a +30 VDC. The +30 VDC is fed to a +24 V voltage regulator in A2; the regulated +24 V is delivered to the pulser FET A6 and to a +15 V voltage regulator in A2; the regulated +15 V supplies power to the control circuit in A3 and to a +6 V voltage regulator in A2; the regulated +6 V supplies power to the timer in A4, to a power ON/OFF LED indicator in A3, and through the diode DR2 a standby level is established. The locks in B1 and B2 unlock when energized, thus a Hi from the standby level keeps them UNLOCKed and a Lo causes them to LOCK.

The principle of operation is as follows:

Note: The term "door" refers to the dark room's main door.

The term "lid" refers to the lid of a hopper or cabinet where film sensitive to light is stored.

When the door and the lid are closed and the light is OFF, the sensors in B1 and B2 and the light sensor C provides a continuous Lo signal to the discriminator inputs A, B and C in A3, this causes outputs A3-X and A3-Y to remain Hi causing the infrared emitters of the opto couplers X and Y in A5 and X signal to opto couplers contained in B3 and B4 to stay ON. Outputs A5-X and A5-Y consequently turn the FETs in A7 and A8 ON, thus A7-X supplies the standby level to B1 and A8-Y supplies the standby level to B2 causing the locks B1 and B2 to remain UNLOCK, and the X signal at B3 and B4 causes the electronic relays to stay CONDUCTIVE. At this stage it is possible to open either the lid or the door, or turn the light ON and/or open the door.

This stage is called STANDBY and will be referred to in the following explanations.

In the preferred embodiment, the electronic control circuit means for producing Hi and Lo commands in response to Hi and Lo input signal means obeys the following truth table:

| INPUTS | | | OUTPUTS | |
|---|---|---|---|---|
| A | B | C | X | Y |
| O | O | O | I | I |
| I | O* | O | I | O |
| I | O* | I | I | O |
| O | O* | I | I | O |
| O* | I | O* | O | I |

wherein A=door detector: B=lid detector: and C=light detector. 0=Lo, I=Hi. X controls door's lock and the electronic relays, Y controls hopper's lock. 0* is a stage in which the Lo is locked by the electric lock and can not be changed to Hi unless the inputs being Hi is or are changed to Lo.

DOOR OPENING: At STANDBY, if a person opens the door, the sensor in B1 will deliver a Hi signal to the A input in A3, then the discriminator circuit will command A3-Y to turn Lo causing the opto coupler-/isolator in A5 to turn Lo; the Lo A5-Y will turn OFF the FET in A8 causing A8-Y to command a Lo signal to B2 causing the lock in B2 to LOCK. At this stage it is not possible to open the hopper, but it is possible to turn the light ON.

DOOR CLOSING: When the door is closed, the sensor in B1 generates a Lo signal to the A input in A3 causing A3-Y to turn Hi and a triggering pulse will generate at A3-Z. A3-Y will turn ON the Y opto coupler in A5, consequently A5-Y will turn ON the FET in A8; at the same time A3-Z triggers the timer in A4 causing A4-Z to generate a 500 m/s pulse which is used to turn ON the Z opto coupler/isolator in A5. A5-Z commands the FET in A6 to turn ON, consequently A6-Z will deliver a +24 V 500 m/s pulse to the L FETs in A7 and A8; A7-X and A8-Y will deliver a +24 V 500 m/s pulse followed by the STANDBY level to B1 and B2 respectively, causing the lock B1 to remain UNLOCK and B2 to unlock and remain UNLOCK. B3 and B4 remains CONDUCTIVE. Following the system will remain in STANDBY.

LIGHT TURNED ON: If the light is turned ON while the door is open, it will be detected by the light sensor C in A3 but no changes will occur at the outputs. If the light is turned ON at STANDBY, it will be detected by the sensor C in A3, and will cause A3-Y, A5-Y, A8-Y and B2 to repeat exactly the same sequence as above when the sensor in B1 detected the opening of the door in DOOR OPENING.

At this stage it is not possible to open the lid, but it is possible to open the door. If the door is opened, it will be detected by the sensor in B1, but no changes will occur at the outputs.

LIGHT TURNED OFF: If the light is turned OFF while the door is open, it will be detected by the light sensor C in A3 but no changes will occur at the outputs. If the light is turned OFF when the door is closed, the change will be detected by the light sensor C in A3 and will cause A3-Y, A5-Y, A8-Y, B2 and A3-Z, A4-Z, A5-Z, A6-Z to repeat the same sequence as above in DOOR CLOSING, returning the system to STANDBY.

HOPPER OPENING: If at STANDBY the lid is opened, the sensor in B2 will deliver a Hi signal to the B input in A3 causing A3-X to command a Lo signal to the X opto coupler/isolator in A5 causing it to turn Lo. A5-X will turn OFF the FET in A7 consequently A7-X commands a Lo to B1 causing the lock in B1 to LOCK, at the same time the Lo A3-X at B3 and B4 will cause the opto coupler/isolators in B3 and B4 to turn OFF, causing the electronic relays in B3 and B4 to turn to OPEN CIRCUIT.

At this stage it is not possible to open the door or turn the light ON.

LIGHT SWITCH: If the light switch is turned to ON and left in the ON position when the lid is open, the light will turn ON at the instant the lid is closed, then the light will be detected by the light sensor C and the discriminator in A3 will instantly command A3-Y to turn Lo, A3-X to turn Hi and A3-Z to generate a triggering pulse, consequently A3-Y causes A5-Y to turn Lo which in turn causes A8-Y to command a Lo signal to B2 causing the lock in B2 to LOCK; A3-X causes A5-X to turn Hi which in turn causes the FET in A7 to turn ON; A3-Z triggers the timer in A4 causing A4-Z to generate a 500 m/s pulse to the opto coupler/isolator in A5; A5-Z turns ON the FET in A6; A6-Z will deliver a +24 V 500 m/s to the FETs in A7 and A8, since the FET in A8 is OFF there is no effect at A8-Y; A7-X delivers a +24 V 500 m/s pulse followed by the standby level to B1, causing the lock at B1 to UNLOCK. Thus, the light is ON, the door can be opened, the lid is LOCK.

HOPPER CLOSING: When closing the lid while the light switch is in the OFF position, the sensor in B2 will provide a Lo signal to input B in A3 causing A3-X to turn Hi and A3-Z to generate a triggering pulse. A3-Y remains Hi. A3-X turns the opto coupler/isolator in A5 to ON, A5-X causes the FET in A7 to turn ON, at the same time A3-Z triggers the timer in A4; A4-Z turns the FET A6 to ON, A6-Z delivers a +24 V 500 m/s pulse to the FETs in A7 and A8, consequently A7-X and A8-Y will deliver a +24 V 500 m/s pulse followed by the STANDBY level to B1 and B2 respectively causing the locks to unlock and remain UNLOCK, and the Hi A3-X at B3 and B4 will cause the relays to turn CONDUCTIVE, thus the system returns to STANDBY.

The purpose of the opto coupler/isolators in A5 is to protect the low voltage circuitry of A3 from the High level produced by the pulser FET A6 and also simplifies the biasing circuitry to all the FETs. The purpose of the opto coupler/isolators in B3 and B4 is to provide very high isolation between the complete system and the mains electricity supply.

A backup battery will allow the system to continue to operate in the case of a mains power failure, however, should the system not be supplied with the backup battery, a power failure will cause the system to LOCK the lid and the door; in such a circumstance, a person can exit the room by the use of a key located at a known site near the door.

What is claimed is:

1. Apparatus to prevent inadvertent opening of a lid to a hopper or cabinet in which light sensitive material may be stored, the hopper or cabinet, in use, being located in a dark room having an entry door, the apparatus comprising;

photosensitive means to detect a change of light in the dark room and to produce a first signal indicative of said change of light, door open/closed detection means to detect an open/closed state of the door and to produce a second signal indicative of said open/closed state of the door, lid open/closed detection means to detect an open/closed state of the lid and to produce a third signal indicative of said open/closed state of the lid, electrically controlled door lock means to lock/unlock the door, electrically controlled lid lock means to lock/unlock the lid, and logic circuit means responsive to said first, second and third signals to produce control signals for controlling the door lock means and the lid lock means.

2. Apparatus of claim 1 wherein said logic circuit means further produces a control signal to control an on/off state of an electric light situated within the dark room.

3. Apparatus of claim 1 wherein said logic circuit means further produces a control signal to control an on/off state of a power socket located in the dark room.

4. An apparatus of claim 1 wherein the door open/closed detection means and/or the lid open/closed detection means comprises a slotted opto/interrupter means.

5. Apparatus of claim 1 wherein said photosensitive means includes a sensitivity adjustment control.

6. A method of preventing inadvertent opening of a lid to a hopper or cabinet in which light sensitive material may be stored, the hopper or cabinet, in use, being located in a dark room having an entry door, the method comprising;

detecting by photosensitive means a change of light in the dark room so as to produce a first signal indicative of said change of light, detecting by way of open/closed detection means an open/closed state of the door so as to produce a second signal indicative of said open/closed state of the door, detecting by way of lid open/closed detection means an open/closed state of the lid so as to produce a third signal indicative of said open/closed state of the lid, providing electrically controlled door lock means to lock/unlock the door, providing electrically controlled lid lock means to lock/unlock the lid, and providing logic circuit means which respond to said first, second and third signals so as to produce control signals for controlling the door means and the lid lock means.

* * * * *